US006679204B2

(12) United States Patent
Iida et al.

(10) Patent No.: US 6,679,204 B2
(45) Date of Patent: Jan. 20, 2004

(54) VALVE DRIVING APPARATUS OF INTERNAL COMBUSTION ENGINE

(75) Inventors: Tatsuo Iida, Anjo (JP); Takashi Izuo, Toyota (JP); Eiji Hashimoto, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/216,199

(22) Filed: Aug. 12, 2002

(65) Prior Publication Data

US 2003/0047152 A1 Mar. 13, 2003

(30) Foreign Application Priority Data

Sep. 7, 2001 (JP) ..... 2001-271860

(51) Int. Cl.[7] ..... F01L 9/04

(52) U.S. Cl. ..... 123/90.11; 123/198 E; 251/129.01; 174/68.2

(58) Field of Search ..... 123/90.11, 90.19, 123/90.38, 195 C, 198 E; 251/129.01, 129.02, 129.16; 174/68.2

(56) References Cited

U.S. PATENT DOCUMENTS

| | | | | |
|---|---|---|---|---|
| 1,474,842 A | | 11/1923 | Misuraca | 123/90.11 |
| 5,403,193 A | * | 4/1995 | Ito et al. | 439/34 |
| 5,875,746 A | * | 3/1999 | Izuo | 123/90.11 |
| 6,089,196 A | | 7/2000 | Izuo et al. | 123/90.11 |
| 6,116,570 A | * | 9/2000 | Bulgatz et al. | 251/129.1 |
| 6,158,403 A | * | 12/2000 | Berecewicz et al. | 123/90.11 |
| 6,164,253 A | * | 12/2000 | Alberter et al. | 123/90.11 |
| 6,179,628 B1 | * | 1/2001 | Hasegawa et al. | 439/76.2 |
| 6,278,932 B1 | | 8/2001 | Baumel et al. | 701/104 |

FOREIGN PATENT DOCUMENTS

| | | | |
|---|---|---|---|
| DE | 199 22 425 C1 | 10/2000 | |
| EP | 0 500 219 A1 | 8/1992 | |
| EP | 0 653 278 A1 | 5/1995 | |
| JP | A 10-280999 | 10/1998 | |
| WO | WO 99/31359 | 6/1999 | |
| WO | WO 9931359 A1 * | 6/1999 | F01L/9/04 |
| WO | WO 01/25599 A1 | 4/2001 | |

OTHER PUBLICATIONS

Shiro Nishida, Bus Bar Module, U.S. patent application Pub. No. US 2002/0053456 A1, May 9, 2002.*

Nishida et al., Internal combustion Enigine Having an Electromagnetic Valve Drive Mechanism and Method for Controlling the Time, U.S. patent application Pub. No. US 2001/0032604 A1, Oct. 25, 2001.*

* cited by examiner

*Primary Examiner*—Thomas Denion
*Assistant Examiner*—Ching Chang
(74) *Attorney, Agent, or Firm*—Oliff & Berridge, PLC

(57) ABSTRACT

The valve driving apparatus of an internal combustion engine includes a valve element functioning as an intake valve or an exhaust valve of the internal combustion engine, an electromagnetic actuator for driving the valve element, an actuator body having a plurality of electromagnetic actuators mounted thereto, and wiring for supplying electric power to each of the electromagnetic actuators. The actuator body has a flow path for allowing a cooling medium to flow therethrough. The wiring is provided near the flow path of the actuator body. This structure enables a reduction in space for power distribution while minimizing overheating of the wires.

11 Claims, 12 Drawing Sheets

VALVE DRIVING APPARATUS OF INTERNAL COMBUSTION ENGINE

INCORPORATION BY REFERENCE

The disclosure of Japanese Patent Application No. 2001-271860 filed on Sep. 7, 2001, including the specification, drawings and abstract is incorporated herein by reference in its entirety.

BACKGROUND OF THE INVENTION

1. Field of the Invention

The invention relates to a valve driving apparatus for electromagnetically opening and closing a valve element functioning as an intake valve or exhaust valve of an internal combustion engine.

2. Description of Related Art

A valve driving apparatus for electromagnetically driving a valve element functioning as an intake valve or exhaust valve of an internal combustion engine has been known. For example, in a valve driving apparatus proposed in Japanese Patent Laid-Open Publication No. 10-280999, a plurality of electromagnetic actuators for driving a valve element is mounted to an actuator body. Moreover, wiring for distributing electric power to each electromagnetic actuator are also mounted to the actuator body. Each electromagnetic actuator includes an armature that is displaced integrally with a valve element, a pair of springs for biasing the armature to a neutral position, and a pair of electromagnets arranged in the direction in which the armature is displaced. When an exciting current is applied to an electromagnetic coil of the electromagnet, the armature is subjected to electromagnetic force toward the electromagnet. Accordingly, alternately applying an exciting current to the pair of electromagnets reciprocates the valve element, whereby each valve is opened or closed.

The above valve driving apparatus requires two wires for each electromagnet in order to distribute electric power to the electromagnetic coil of the electromagnet. Since each electromagnetic actuator uses a pair of electromagnets, four wires are required for each electromagnetic actuator. The valve driving apparatus therefore has an extremely large number of wires. For example, a four-cylinder internal combustion engine having four valves per cylinder would require sixty-four wires. Such a large number of wires require a large space. Moreover, a large connector is required to connect the wires to external drive circuitry.

One way to solve these problems is to reduce the thickness of the wires. However, a wire with a reduced cross-sectional area has an increased electric resistance (increased copper losses), thereby increasing the heating value. Therefore, the wires may overheat if a great amount of current is applied thereto. The reduced thickness of the wires enables a reduction in space for power distribution, but on the other hand causes overheating of the wires.

SUMMARY OF THE INVENTION

In view of the foregoing problems, it is an object of the invention to provide a valve driving apparatus of an internal combustion engine which enables a reduction in space for power distribution while minimizing overheating of the wires.

In order to achieve the foregoing object, in a valve driving apparatus of an internal combustion engine according to one aspect of the invention, a plurality of electromagnetic actuators for driving a valve element functioning as an intake valve or an exhaust valve of the internal combustion engine is mounted to an actuator body, and wiring for supplying electric power to each of the electromagnetic actuators is mounted to the actuator body. The actuator body has a flow path for allowing a cooling medium to flow therethrough. The wiring is provided near the flow path of the actuator body.

In the above valve driving apparatus, electric power is distributed to each electromagnetic actuator through the wiring mounted to the actuator body. As a result, each electromagnetic actuator is operated to drive a corresponding valve element, whereby the valve element functions as an intake valve or an exhaust valve. Heat generated by a current flowing through the wiring is partially transmitted to the actuator body and dissipated by the cooling medium flowing through the flow path. Since the wiring is provided near the flow path, most of the heat generated by the wiring is efficiently dissipated by the cooling medium. Although the use of thin wires generally increases the heating value, such improved heat dissipation suppresses overheating of the wires. Moreover, even if a large number of wires are required, the use of thin wires reduces the space required for them, and also reduces the size of connectors for connecting the wires to external drive circuitry. A reduction in space for power distribution is thus achieved while minimizing overheating of the wires.

BRIEF DESCRIPTION OF THE DRAWINGS

The above mentioned embodiment and other embodiments, objects, features, advantages, technical and industrial significance of this invention will be better understood by reading the following detailed description of the exemplary embodiments of the invention, when considered in connection with the accompanying drawings, in which.

DETAILED DESCRIPTION OF THE PREFERRED EMBODIMENTS

In the following description and the accompanying drawings, the invention will be described in more detail in terms of exemplary embodiments.

First Embodiment

Hereinafter, a valve driving apparatus according to the first embodiment of the invention will be described with reference to FIGS. 1 to 6. In the first embodiment, the valve driving apparatus is applied to an internal combustion engine having a plurality of cylinders.

Figure 1:
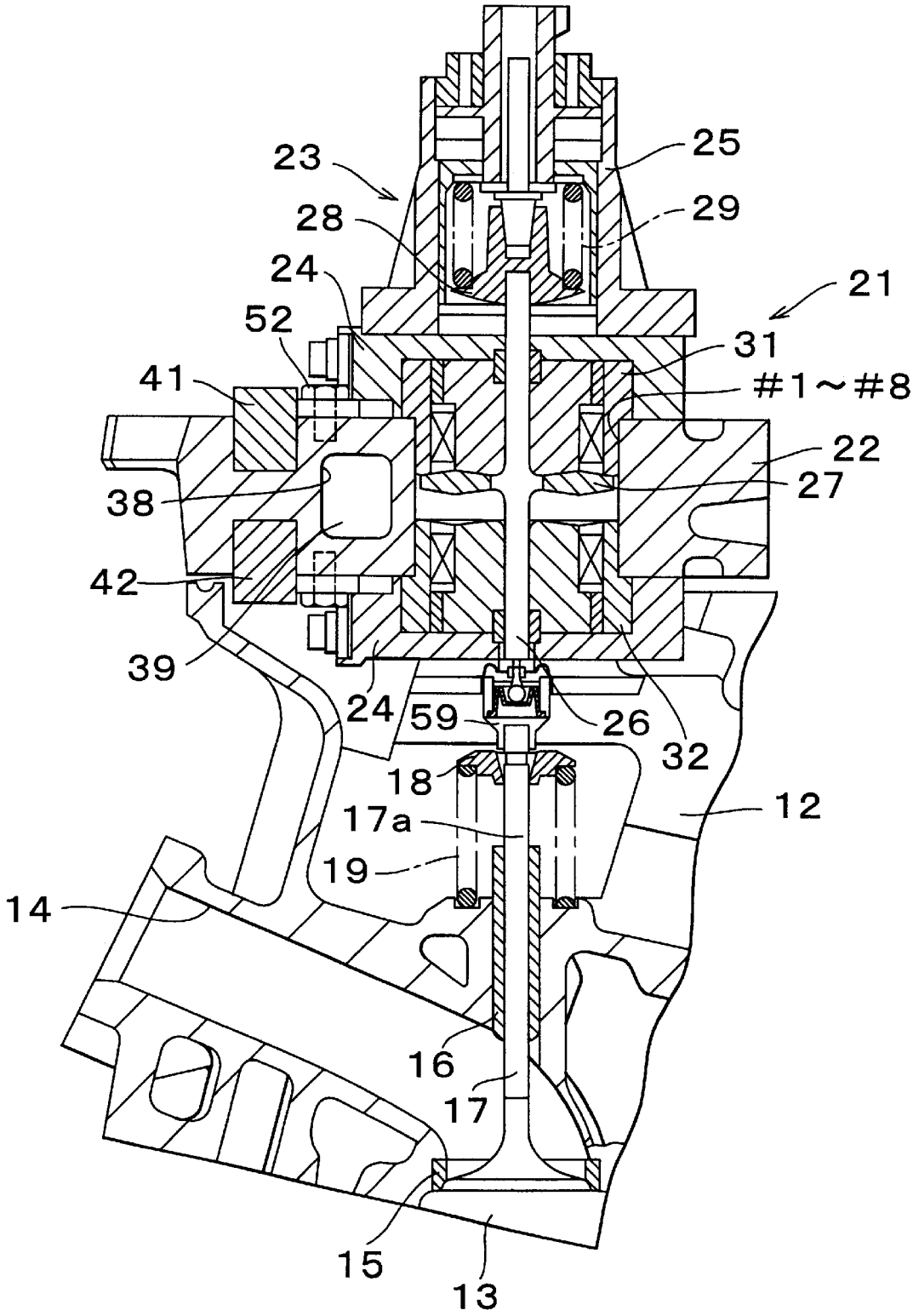
FIG. 1 is a cross-sectional view of a valve driving apparatus and its peripheral portion according to a first embodiment of the invention.

As shown in FIG. 1, a cylinder head 12 of an internal combustion engine has ports 14 each communicating with a combustion chamber 13 of a corresponding cylinder. Each port 14 forms a part of an intake passage or exhaust passage. It is herein assumed that the internal combustion engine of the first embodiment is a four-cylinder engine having two intake ports 14 and two exhaust ports 14 (i.e., four ports in total) for each cylinder. Each port 14 has a valve seat 15 at one end facing a corresponding combustion chamber 13.

A valve guide 16 is fixed to the cylinder head 12 at each port 14. Valve elements 17 function as intake valves or exhaust valves, and each valve guide 16 supports a valve shaft 17*a* of a corresponding valve element 17 so that the valve shaft 17*a* can reciprocate in the axial direction (the vertical direction in the figure). As the valve element 17 is moved downward and away from the valve seat 15, the port 14 communicates with the combustion chamber 13 (open state). On the other hand, as the valve element 17 is moved upward onto the valve seat 15, the port 14 is disconnected from the combustion chamber 13 (closed state). A lower retainer 18 is mounted to the upper end of each valve shaft 17*a*. Each lower retainer 18 and each valve element 17 are always biased upward, i.e., in the valve-closing direction, by a lower spring 19.

Figure 2:
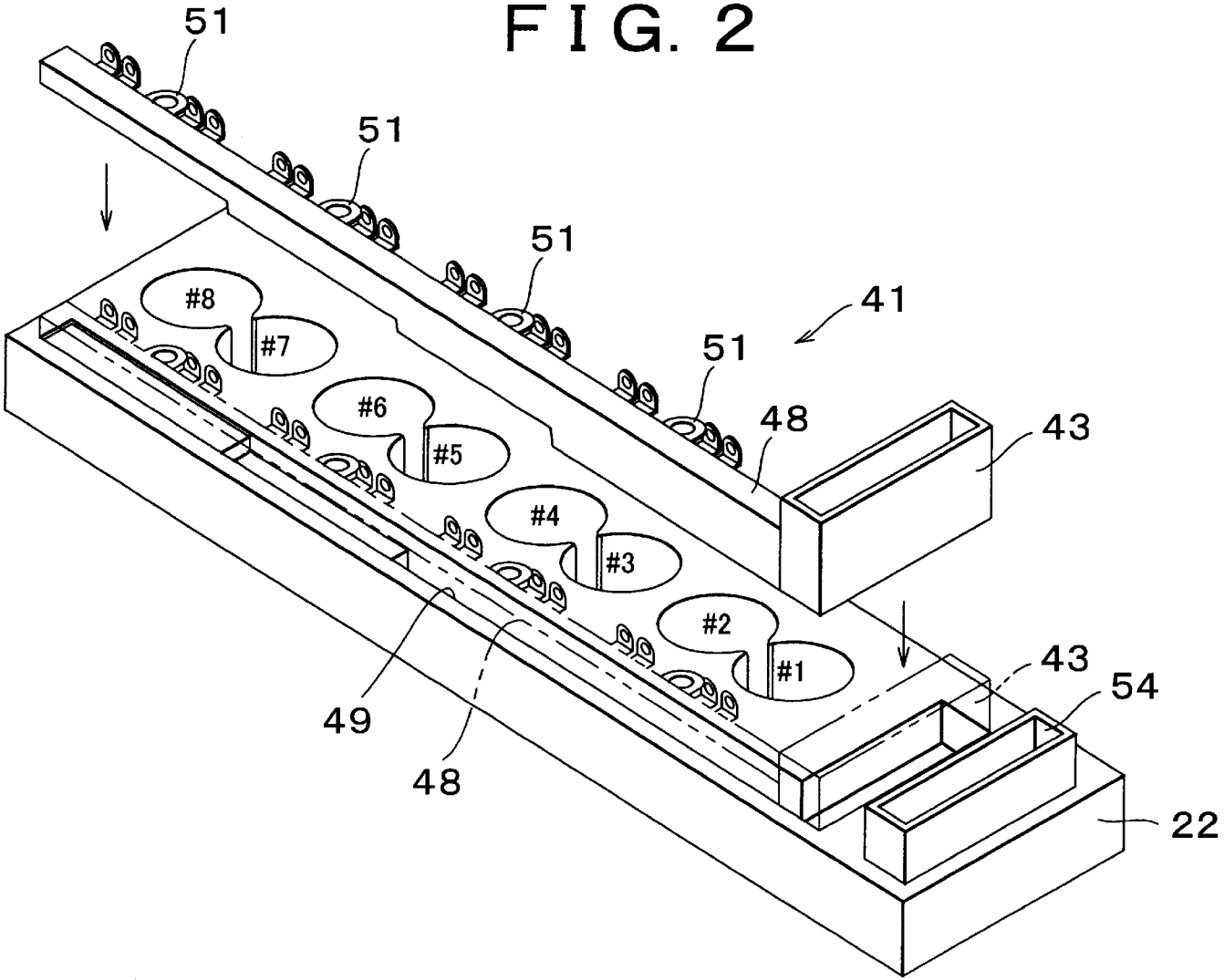
FIG. 2 is a perspective view of the state before an upper bus bar is mounted to an actuator body.

An exhaust valve driving apparatus 21 and an intake valve driving apparatus 21 are provided in the cylinder head 12 in order to drive the intake valve elements 17 and the exhaust valve elements 17, respectively. Each valve driving apparatus 21 has an actuator body 22. Each actuator body 22 has an elongated shape in the direction in which the valve elements 17 are arranged (the direction perpendicular to the plane of FIG. 1). Each actuator body 22 is fixed to the cylinder head 12 by fixing means (not shown) such as bolts. As shown in FIGS. 1 and 2, each actuator body 22 has holes for receiving corresponding electromagnetic actuators at positions corresponding to the valve elements 17. Hereinafter, these holes are identified as hole #1, hole #2, . . . hole #7, hole #8 sequentially from the position near central connectors 43, 54 described below.

As shown in FIG. 1, the electromagnetic actuator 23 mounted in each hole #1 to #8 has a pair of upper and lower flanges 24, an upper cap 25, an armature shaft 26, an upper spring 29 and the like. The upper and lower flanges 24 are respectively provided on the top and bottom surfaces of each actuator body 22 at positions corresponding to the holes #1 to #8. The upper and lower flanges 24 are fixed to the actuator body 22 by fixing means (not shown) such as bolts. The upper cap 25 is attached to the upper flange 24. The armature shaft 26 is formed from a non-magnetic material and extends through each hole #1 to #8. An armature 27 formed from a soft magnetic material is bonded to the armature shaft 26 between the upper and lower flanges 24.

The armature shaft 26 extends through the upper flange 24 into the upper cap 25 so that the upper end of the armature shaft 26 is located within the upper cap 25. An upper retainer 28 is attached to the upper end of the armature shaft 26. The upper spring 29 constantly biases the upper retainer 28 and the armature shaft 26 downward. This biasing force allows the lower end of the armature shaft 26 extending through the lower flange 24 to be connected to the valve element 17 through a lash adjuster 59. The upper spring 29 biases the upper retainer 28 in the same direction as the opening direction of the valve element 17 (downward in the figure). The lash adjuster 59 absorbs both the difference in thermal expansion between the valve element 17 and the cylinder head 12 and the relative displacement between the valve element 17 and the armature shaft 26 resulting from friction at the seat surface of the valve seat 15. The lash adjuster 59 thus prevents a clearance from being produced between the valve element 17 and the armature shaft 26.

Each electromagnetic actuator 23 electromagnetically drives the valve element 17 against the biasing force of the lower spring 19 and the upper spring 29. In order to electromagnetically drive the valve element 17, each electromagnetic actuator 23 has an upper core assembly 31 and a lower core assembly 32 each functioning as an electromagnet. The upper core assembly 31 is attached to the actuator body 22 through the upper flange 24. The lower core assembly 32 is attached to the actuator body 22 through the lower flange 24.

Figure 5:
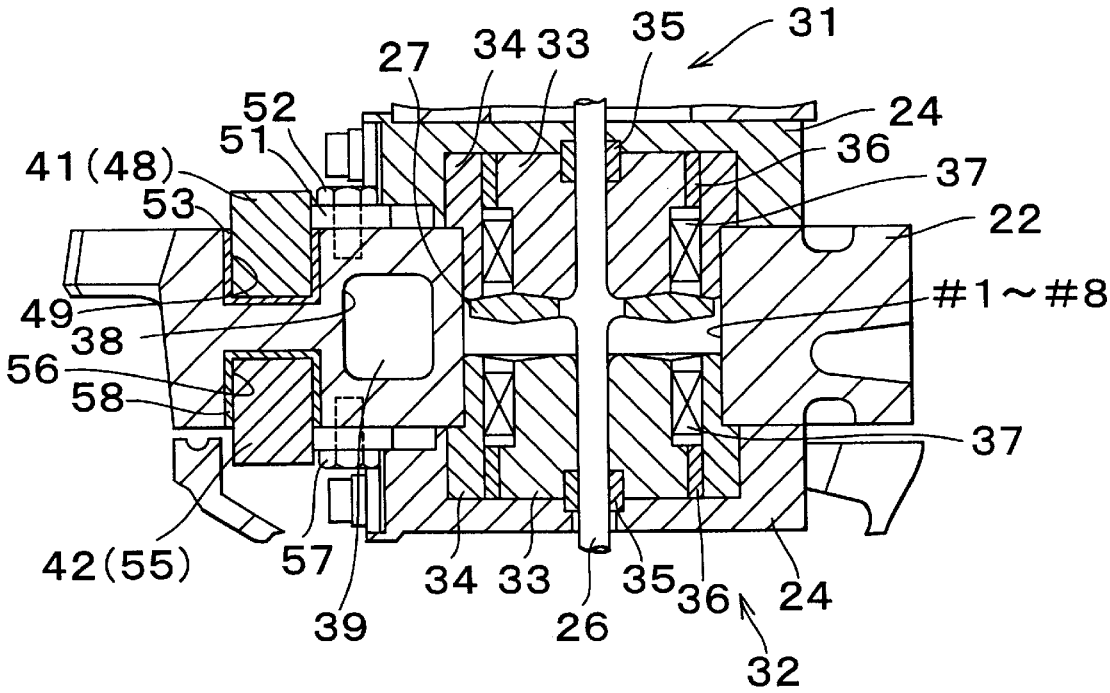
FIG. 5 is an enlarged cross-sectional view of the actuator body and its peripheral portion in the valve driving apparatus of FIG. 1.

As shown in FIG. 5, the upper core assembly 31 has a core, a permanent magnet 36 and an electromagnetic coil 37. The core is divided into two parts, that is, an inner core 33 and an outer core 34. The inner core 33 and the outer core 34 are formed from an iron core material, an electromagnetic material. The inner core 33 and the outer core 34 are fixed to the flange 24 at a distance from each other so as to be magnetically insulated from each other.

The permanent magnet 36 has an annular shape and is provided between the upper parts of the inner core 33 and the outer core 34. The permanent magnet 36 is polarized so that its inner peripheral portion and outer peripheral portion have different polarities (south pole and north pole). The electromagnetic coil 37 is provided between the inner core 33 and the outer core 34. The electromagnetic coil 37 is located under the permanent magnet 36 with a gap therebetween.

The lower core assembly 32 has the same structure as that of the upper core assembly 31 described above. The lower core assembly 32 is provided under the upper core assembly 31 with the armature 27 interposed therebetween. The lower core assembly 32 is horizontally symmetrical with the upper core assembly 31 with respect to the horizontal, central plane of the actuator body 22. Each of the upper and lower core assemblies 31, 32 has a slide bearing 35 between the inner core 33 and the flange 24. The slide bearing 35 slidably supports the armature shaft 26.

Each actuator body 22 has a flow path 38 extending in the direction in which the valve elements 17 are arranged (the direction perpendicular to the plane of FIG. 5), for allowing a cooling medium 39 to flow therethrough. Preferred examples of the cooling medium 39 include the existing cooling water for cooling an internal combustion engine, the existing lubricating oil for lubricating each part of the internal combustion engine, and the like. A new cooling medium may be used instead of these existing cooling media. If the existing cooling medium (especially, lubricating oil) has a high temperature, it is effective to adjust (lower) the temperature of the cooling medium before it enters the flow path 38.

Figure 3:
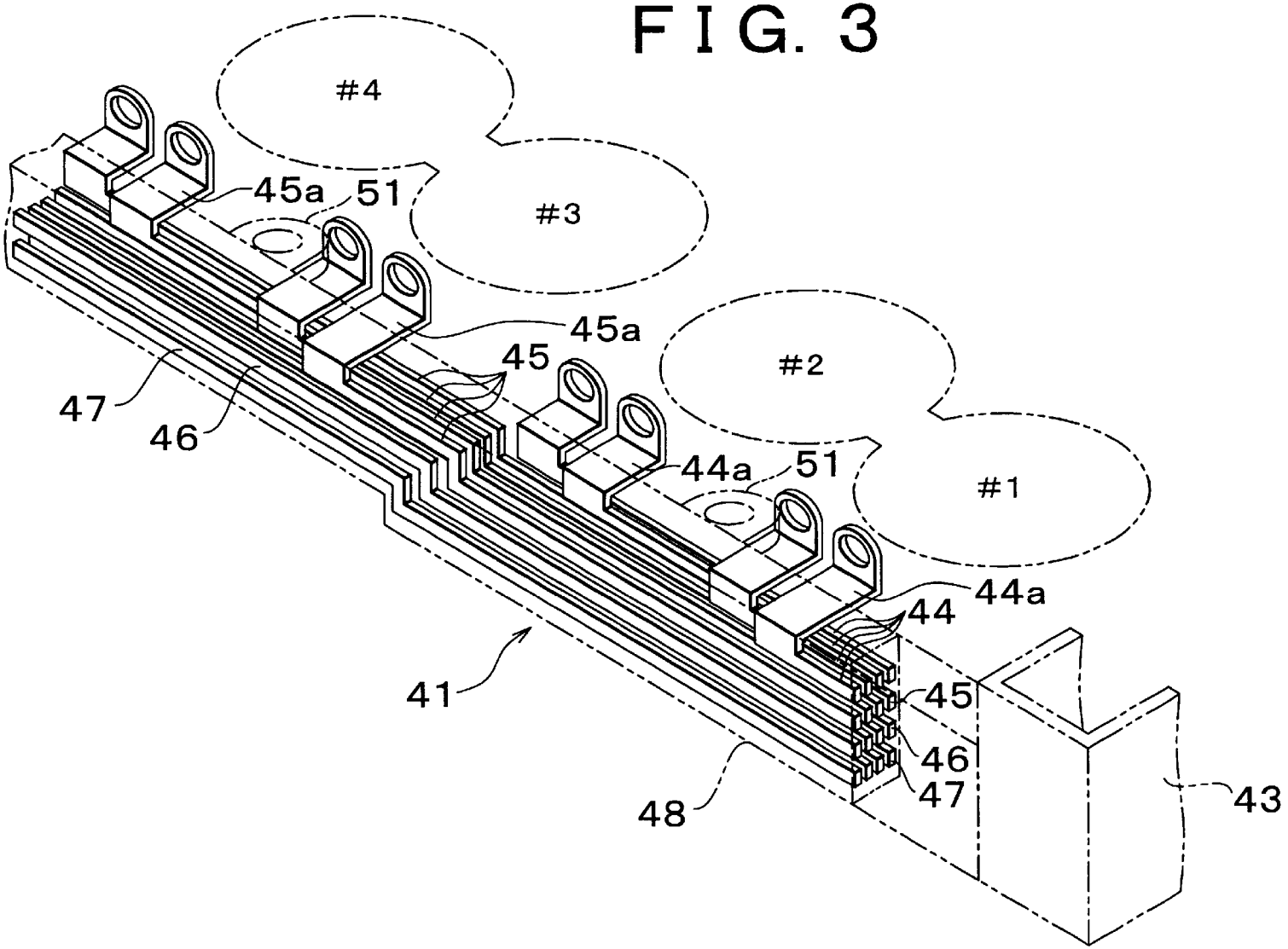
FIG. 3 is a partial perspective view of the upper bus bar, showing a central connector and bar-like conductive members arranged near the central connector.
Figure 4:
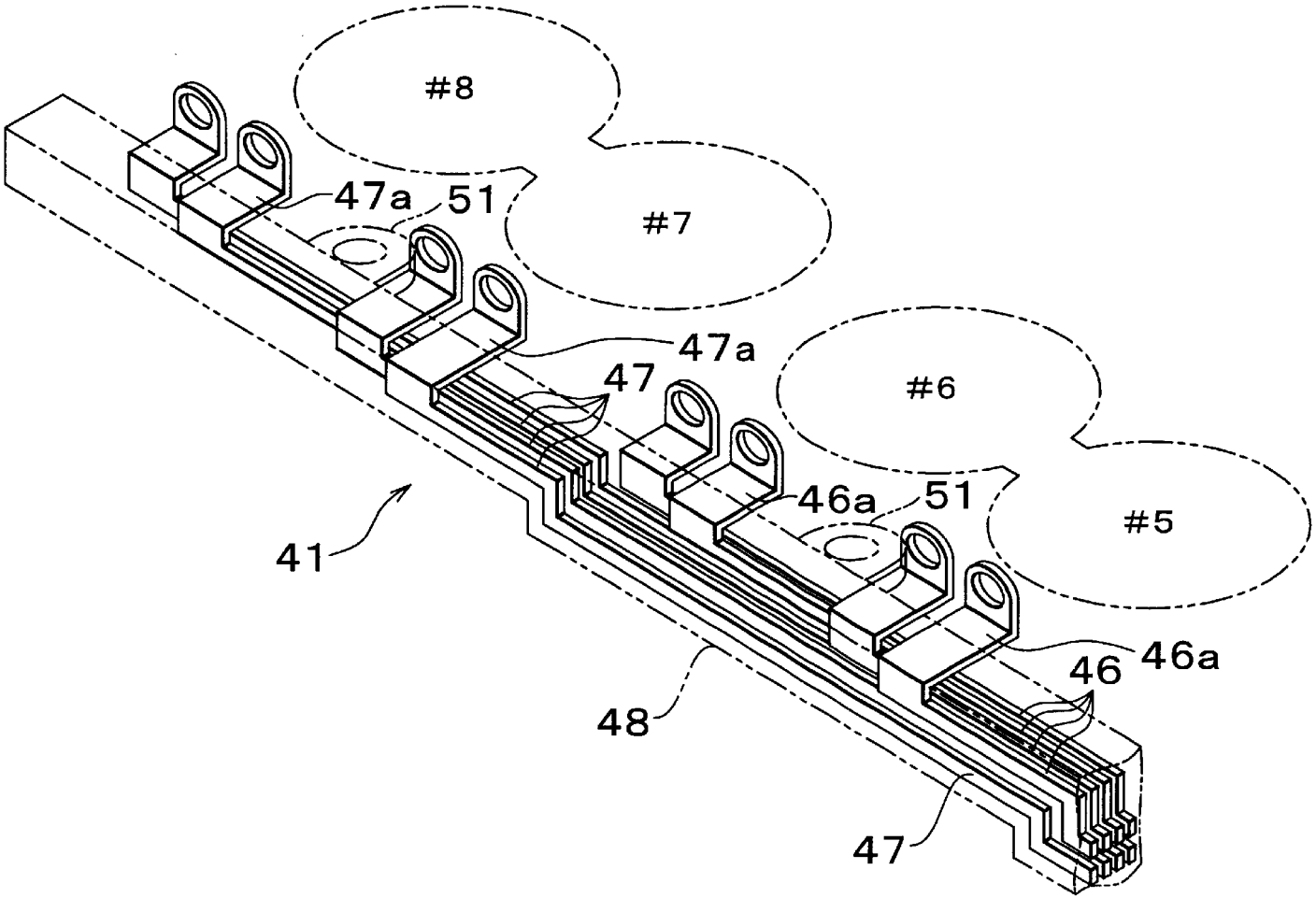
FIG. 4 is a partial perspective view of the upper bus bar, showing a distal end of the bar-like conductive members.

In the upper part of each actuator body 22, an upper bus bar 41 is mounted near the fluid path 38. The upper bus bar 41 serves as wiring for distributing electric power to the upper core assembly 31 of a corresponding electromagnetic actuator 23. As shown in FIGS. 2 to 4, the upper bus bar 41 has a plurality of (sixteen) bar-like conductive members. Each bar-like conductive member has a quadrangular cross-section such as rectangle. The bar-like conductive members are arranged at a distance from each other. In the present embodiment, these sixteen bar-like conductive members are divided into four groups arranged at different levels. In each group, four bar-like conductive members are arranged at a distance from each other in the widthwise direction (horizontal direction). In each group, one end (proximal end) of each bar-like conductive member is connected to a common connector 43 (hereinafter, referred to as central connector) mounted at the end of the actuator body 22. The other end (distal end) of each bar-like conductive member is connected to the upper core assembly 31 of a corresponding electromagnetic actuator 23.

A drive circuit connector 63 (see FIG. 6) described below is detachably connected to the central connector 43 in order to electrically connect each electromagnetic actuator 23 to drive circuitry (not shown). The central connector 43 is connected to the drive circuit connector 63 in the axial direction of the valve element 17 (the vertical direction in FIG. 2).

In order to identify the individual bar-like conductive members, the plurality of bar-like conductive members is divided into the following four groups: four bar-like conductive members 44 connected to the central connector 43 at the highest level; four bar-like conductive members 45 connected to the central connector 43 at the second highest level; four bar-like conductive members 46 connected to the central connector 43 at the third highest level; and four bar-like conductive members 47 connected to the central connector 43 at the lowest level.

The bar-like conductive members 44 distribute electric power to the electromagnetic actuators 23 respectively mounted in the holes #1, #2. The length of the bar-like conductive members 44 is varied so that a bar-like conductive member 44 located closer to the holes #1, #2 has a longer length. Each bar-like conductive member 44 has its distal end bent toward the holes #1, #2. Each bar-like conductive member 44 is electrically connected to a terminal (not shown) of a corresponding upper core assembly 31 at this bent portion 44*a*.

The bar-like conductive members 45 distribute electric power to the electromagnetic actuators 23 respectively mounted in the holes #3, #4. The length of the bar-like conductive members 45 is varied so that a bar-like conductive member 45 located closer to the holes #3, #4 has a longer length. Each bar-like conductive member 45 is bent at a position corresponding to the boundary between the holes #2 and #3, so that the bar-like conductive members 45 are located at the highest level, the same level as that of the bar-like conductive members 44, in the region corresponding to the holes #3, #4. Each bar-like conductive member 45 has its distal end bent toward the holes #3, #4. Each bar-like conductive member 45 is electrically connected to a terminal (not shown) of a corresponding upper core assembly 31 at this bent portion 45*a*.

As shown in FIGS. 3 and 4, the bar-like conductive members 46 distribute electric power to the electromagnetic actuators 23 respectively mounted in the holes #5, #6. The length of the bar-like conductive members 46 is varied so that a bar-like conductive member 46 located closer to the holes #5, #6 has a longer length. Each bar-like conductive member 46 is bent at a position corresponding to the boundary between the holes #2 and #3, so that the bar-like conductive members 46 are located at the second highest level in the region corresponding to the holes #3, #4. Moreover, each bar-like conductive member 46 is bent at a position corresponding to the boundary between the holes #4 and #5, so that the bar-like conductive members 46 are located at the highest level, the same level as that of the bar-like conductive members 44, in the region corresponding to the holes #5, #6. Each bar-like conductive member 46 has its distal end bent toward the holes #5, #6. Each bar-like conductive member 46 is electrically connected to a terminal (not shown) of a corresponding upper core assembly 31 at this bent portion 46*a*.

The bar-like conductive members 47 distribute electric power to the electromagnetic actuators 23 respectively mounted in the holes #7, #8. The length of the bar-like conductive members 47 is varied so that a bar-like conductive member 47 located closer to the holes #7, #8 has a longer length. Each bar-like conductive member 47 is bent at a position corresponding to the boundary between the holes #2 and #3, so that the bar-like conductive members 47 are located at the third highest level in the region corresponding to the holes #3, #4. Moreover, each bar-like conductive member 47 is bent at a position corresponding to the boundary between the holes #4 and #5, so that the bar-like conductive members 47 are located at the second highest level in the region corresponding to the holes #5, #6. Moreover, each bar-like conductive member 47 is bent at a position corresponding to the boundary between the holes #6 and #7, so that the bar-like conductive members 47 are located at the highest level, the same level as that of the bar-like conductive members 44, in the region corresponding to the holes #7, #8. Each bar-like conductive member 47 has its distal end bent toward the holes #7, #8. Each bar-like conductive member 47 is electrically connected to a terminal (not shown) of a corresponding upper core assembly 31 at this bent portion 47*a*.

All groups of bar-like conductive members 44 to 47 are thus present in the region corresponding to the holes #1, #2. Three groups of bar-like conductive members 45 to 47 are present in the region corresponding to the holes #3, #4. Two groups of bar-like conductive members 46,47 are present in the region corresponding to the holes #5 #6. One group of bar-like conductive members 47 is present in the region corresponding to the holes #7, #8. In other words, the number of groups is reduced as the distance from the central connector 43 is increased. Every group of bar-like conductive members 44 to 47 is connected to the corresponding electromagnetic actuators 23 at the same level (the highest level).

The bar-like conductive members 44 to 47 are enclosed with a synthetic resin body 48 except the ends of the bent portions 44*a* to 47*a*. The space between adjacent bar-like conductive members 44 to 47 is completely filled with the synthetic resin. The body 48 is formed with a mold, and has a vertical width (thickness) varied according to the number of bar-like conductive members 44 to 47. More specifically, the body 48 has a flat top surface and a stepped bottom surface. The distance between the top surface and the bottom surface is reduced (i.e., the level of the bottom surface is elevated) as the distance from the central connector 43 is increased. Therefore, the thickness of the body 48 is greatest in the region corresponding to the holes #1, #2, and is gradually reduced in the regions corresponding to the holes #3, #4, the holes #5, #6, and the holds #7, #8. In other words, the thickness of the body 48 is reduced as the number of bar-like conductive members 44 to 47 is reduced, that is, as the distance from the central connector 43 is increased.

The upper bus bar 41 having the above structure is mounted to the actuator body 22 so that at least a part of the body 48 is fitted in a groove 49 formed at the top surface of the actuator body 22. The body 48 has projections 51 at the side surface thereof. As shown in FIG. 5, the upper bus bar 41 is fixed to the actuator body 22 by fixing means such as bolts 52 extending through the projections 51. The clearance between the wall surface of the groove 49 and the body 48 is filled with a synthetic resin 53 (hereinafter, referred to as "mold resin"). For example, the clearance may be filled with the mold resin 53 as follows: the actuator body 22 having the upper bus bar 41 fixed thereto by the bolts 52 is placed in a prescribed mold, and the clearance, a molding space, is filled with a molten synthetic resin. The molten synthetic resin filling the clearance is then cured.

In the lower part of each actuator body 22, a lower bus bar 42 is mounted near the fluid path 38. The lower bus bar 42 serves as wiring for distributing electric power to the lower core assembly 32 of each electromagnetic actuator 23. Like the upper bus bar 41, the lower bus bar 42 has a central connector 54 (see FIG. 2), a multiplicity of bar-like conductive members (not shown) extending from the central connector 54 in the direction in which the electromagnetic actuators 23 are arranged, and a synthetic resin body 55 enclosing the bar-like conductive members. The central connector 54 is mounted to the actuator body 22 so as to extend in parallel with the central connector 43 of the upper bus bar 41. A part of the central connector 54 is exposed from the top surface of the actuator body 22. The bar-like conductive members and the body 55 of the lower bus bar 42 have the same structure as that of the bar-like conductive members and the body 48 of the upper bus bar 41. The lower bus bar 42 is horizontally symmetrical with the upper bus bar 41 with respect to the horizontal, central plane of the actuator body 22.

At least a part of the body 55 is fitted in a groove 56 formed at the bottom surface of the actuator body 22. Like the upper bus bar 41, the lower bus bar 42 is fixed to the actuator body 22 by fixing means such as bolts 57, and the clearance between the wall surface of the groove 56 and the body 55 is filled with a mold resin 58.

Figure 6:
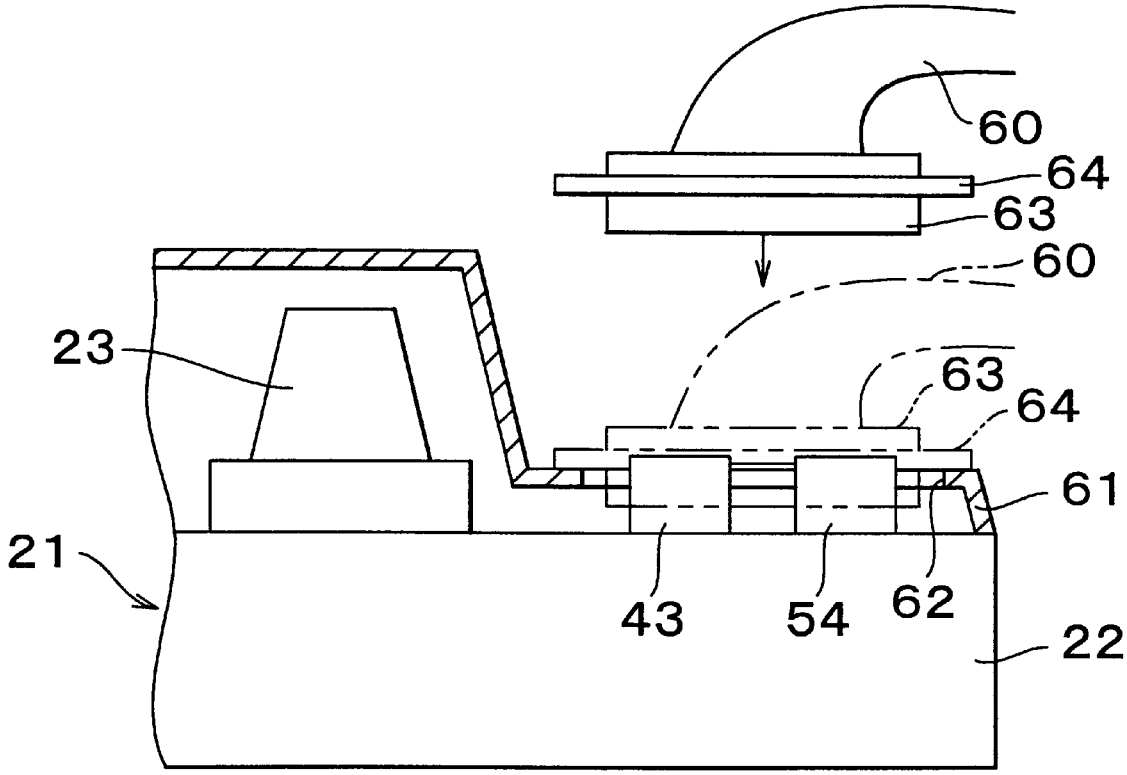
FIG. 6 schematically illustrates the relation between elements such central connectors, a drive circuit connector and a head cover.

As described above, the intake valve driving apparatus 21 and the exhaust valve driving apparatus 21 are fixed to the cylinder head 12. As shown in FIG. 6, a head cover 61 is attached to the valve driving apparatuses 21 so as to cover them. The drive circuit connector 63 connected to the drive circuitry through a harness 60 is detachably connected to the central connectors 43, 54 through the head cover 61. This detachable connection is implemented as follows: the head cover 61 has a through hole 62 in the region corresponding to the central connectors 43, 54 of each valve driving apparatus 21. The through hole 62 is sized to allow for communication between the inside and the outside of the head cover 61 and to allow the central connectors 43, 54 to extend therethrough. The drive circuit connector 63 has a flange 64 that is larger than the through hole 62.

The drive circuit connector 63 is connected to the central connectors 43, 54 as follows: the drive circuit connector 63 is inserted into the head cover 61 via the through hole 62. The drive circuit connector 63 is connected to the central connectors 43, 54 in the course of insertion. As shown by two-dotted chain line in FIG. 6, when the flange 64 contacts the head cover 61, the bar-like conductive members 44 to 47 of each bus bar 41, 42 are electrically connected to the drive circuitry through the connectors 43, 54, 63. In this state, the flange 64 closes the through hole 62. Note that the drive circuit connector 63 is disconnected from the central connectors 43, 54 by conducting the above operation in the inverse order.

Each valve driving apparatus 21 having the above structure controls power distribution to the upper core assembly 31 of each electromagnetic actuator 23 through the bar-like conductive members 44 to 47 of the upper bus bar 41 mounted to the actuator body 22. Similarly, each valve driving apparatus 21 controls power distribution to the lower core assembly 32 through the bar-like conductive members of the lower bus bar 42. When no current is applied to the electromagnetic coils 37 of the core assemblies 31, 32, the armature 27 is held at the neutral position between the springs 29, 19, that is, approximately at the central position between the core assemblies 31, 32. When an attracting current is applied to the electromagnetic coil 37 of the upper core assembly 31, the armature 27 is subjected to upward electromagnetic force. As a result, the armature 27 is displaced toward the upper core assembly 31. When the armature 27 abuts against the inner core 33 and the outer core 34 of the upper core assembly 31, the valve element 17 is seated on the valve seat 15. The valve element 17 is thus closed.

When a release current is applied to the electromagnetic coil 37 of the upper core assembly 31, the armature 27 starts being displaced in the valve-opening direction, that is, toward the lower core assembly 32, by the biasing force of the upper spring 29. A current is applied to the electromagnetic coil 37 of the lower core assembly 32 as soon as the armature 27 is displaced by a prescribed amount in the valve-opening direction. As a result, the armature 27 is subjected to electromagnetic force toward the lower core assembly 32. When the armature 27 abuts against the inner core 33 and the outer core 34 of the lower core assembly 32, the valve element 17 is fully opened.

A release current is applied to the electromagnetic coil 37 of the lower core assembly 32 after the armature 27 is held in the fully open state. This eliminates the magnetic attraction force for holding the armature 27 in the fully open state. As a result, the armature 27 starts being displaced in the valve-closing direction (i.e., toward the upper core assembly 31) by the biasing force of the lower spring 19. By alternately applying an exciting current to the electromagnetic coils 37 of the core assemblies 31, 32, the valve element 17 is opened and closed and thus functions as an intake valve or exhaust valve.

In the above valve driving apparatus 21, the armature 27 is subjected to greater biasing force of the spring 29, 19 as it gets closer to the inner core 33 and the outer core 34. In order to attract the armature 27 to the inner core 33 and the outer core 34 against the biasing force of the spring 29, 19 and hold the armature 27 in the attracted state, a large attraction force must be applied between the armature 27 and the upper core assembly 31 and between the armature 27 and the lower core assembly 32.

In the present embodiment, the core is divided into the inner core 33 and the outer core 34 surrounding the inner core 33, and the permanent magnet 36 is mounted between the cores 33, 34. Therefore, as the armature 27 is displaced to a position close to the cores 33, 34, it is subjected to magnetic attraction force toward the cores 33, 34. This eliminates the need to apply a holding current for holding the armature 27 to the core assembly 31, 32, enabling a reduction in power consumption.

As described above, each valve driving apparatus 21 requires a great amount of current for driving the electromagnetic actuators 23. Therefore, heat is generated by the bar-like conductive members 44 to 48 of the bus bars 41, 42. However, the heat is partially transmitted to the actuator body 22 through the bodies 48, 55 and the mold resins 53, 58. The heat thus transmitted to the actuator body 22 is dissipated by the cooling medium 39 flowing through the flow path 38.

The first embodiment described above in detail has the following effects:

(1) As shown in FIGS. 1 and 5, the actuator body 22 has a flow path 38 for allowing the cooling medium 39 to flow therethrough, and grooves 49, 56 formed at the top and bottom surfaces of the actuator body 22. The bus bars 41, 42 are fitted in these grooves 49, 56, whereby the bus bars 41, 42 are arranged near the flow path 38.

This structure allows most of the heat generated by the bar-like conductive members 44 to 47 to be efficiently dissipated by the cooling medium 39 flowing nearby. Although the use of thin wires (in the illustrated example, bar-like conductive members 44 to 47) generally increases the heating value, such improved heat dissipation suppresses overheating of the wires. Moreover, even if a large number of bar-like conductive members are required, the use of the thin bar-like conductive members 44 to 47 reduces the space required for them, and also reduces the size of the central connector 43, 54. The space required for power distribution in the valve driving apparatus 21 is able to be reduced while minimizing overheating of the bar-like conductive members 44 to 47.

(2) Copper wires covered with a soft synthetic resin or the like (cables, cords or the like) may be used as wires. However, bundling the cables, cords or the like would produce a space between adjacent cables, cords or the like, hindering heat transmission.

On the other hand, the first embodiment uses the bus bars 41, 42 as wires. In the bus bars 41, 42, at least the clearance between adjacent bar-like conductive members 44 to 47 is filled with a synthetic resin. Unlike the cables or the like, the bus bars have substantially no space that hinders heat transmission. Accordingly, the heat generated by a current flowing through the bar-like conductive members 44 to 47 is more likely to be transmitted to the actuator body 22 through the bodies 48, 55, and thus to the cooling medium 39 within the flow path 38. Such improved heat dissipation enables the use of the thin bar-like conductive members 44 to 47 while suppressing overheat thereof, whereby the space for power distribution can be reduced in a preferable manner.

(3) The bar-like conductive members 44 to 47 extend in the direction in which the electromagnetic actuators 23 are arranged. Each bar-like conductive member 44 to 47 has its distal end connected to a corresponding electromagnetic actuator 23, and its proximal end connected to the central connector 43, 54. The number of bar-like conductive members 44 to 47 is therefore largest (sixteen) in the region connected to the central connectors 43, 54, and is gradually reduced as the distance from the central connector 43, 54 is increased.

In the first embodiment, the thickness of each bus bar 41, 42 is reduced as the number of bar-like conductive members 44 to 47 is reduced, that is, as the distance from the central connector 43, 54 is increased. This structure reduces the amount of material required for the bodies 48, 55 and thus reduces the cost as compared to the case where the bodies 48, 55 are of a uniform thickness regardless of the distance from the central connector 43, 55. This structure also reduces the weight of the bodies 48, 55, which is effective to reduce the weight of the bus bars 41, 42.

(4) Any clearance between the wall surface of the groove 49, 56 of the actuator body 22 and the bus bar 41, 42 would hinder heat transmission from the bar-like conductive members 44 to 47 to the actuator body 22. In the first embodiment, however, the clearance is filled with the mold resin 53, as shown in FIG. 5. As a result, the heat generated by the bar-like conductive members 44 to 47 is more likely to be transmitted to the actuator body 22 through the mold resin 53, 58. Such further improved heat dissipation enables the heat generated by the bar-like conductive members 44 to 47 to be efficiently transmitted to the cooling medium 39.

(5) As shown by two-dotted chain line in FIG. 6, when the drive circuit connector 63 is connected to the central connectors 43, 54, the flange 64 closes the through hole 62. As a result, the clearance between the drive circuit connector 63 and the head cover 61 is sealed. This prevents lubricating oil or the like supplied to the electromagnetic actuators 23 from leaking outside the head cover 61 via the through hole 62 even if the lubricating oil is scattered within the head cover 61.

(6) The drive circuit connector 63 may be connected to the central connectors 43, 54 in various directions other than the direction of the first embodiment. For example, the drive circuit connector 63 may be connected to the central connectors 43, 54 in the direction perpendicular to the axial direction of the valve element 17. In this case, the central connectors 43, 54 may project in the longitudinal direction (e.g., to the right in FIG. 6) at the top and/or bottom surfaces of the actuator body 22. Notches corresponding to the central connectors 43, 54 are respectively formed in the boundary region of the head cover 61 with the actuator body 22 and the boundary region of the cylinder head 12 with the actuator body 22. The notches thus formed expose the central connectors 43, 54 to the outside of the head cover 61 and the cylinder head 12. The drive circuit connector 63 can be detachably connected to the central connectors 43, 45 in this manner.

In this case, however, the central connectors 43, 54 are located at the mating face between the actuator body 22 and the head cover 61 and the mating face between the actuator body 22 and the cylinder head 12. When other members (central connectors 43, 54) are located in such a region, it is difficult to implement a seal structure that prevents the lubricating oil or the like from leaking to the outside.

In the first embodiment, the drive circuit connector 63 is connected to the central connectors 43, 54 in the axial direction of the valve element 17. The central connectors 43, 54 mounted to the actuator body 22 extend through the through hole 62 formed in the head cover 61. Since the through hole 62 is formed at a distance from the end face of the head cover 61, the central connectors 43, 54 can be arranged in a region different from the above mating faces. As a result, the lubricating oil or the like can be prevented from leaking to the outside with the simple seal structure as described above.

(7) If the drive circuit connector 63 is connected to the central connectors 43, 54 in the direction perpendicular to the axial direction of the valve element 17, a wall may be provided at the top and bottom surfaces of the end of the actuator body 22. In this case, the head cover is attached to the top surface of the upper wall, and the cylinder head is attached to the bottom surface of the lower wall. A hole extending in the direction perpendicular to the axial direction of the valve element 17 is formed in each of the upper and lower walls. The central connectors 43, 54 are inserted into the holes. The drive circuit connector 63 may be detachably connected to the central connectors 43, 54 in this manner.

In this case, however, the insertion direction of the central connectors 43, 54 into the walls is different from (crosses) the direction in which the bodies 48, 55 of the bus bars 41, 42 are mounted to the grooves 49, 56 of the actuator body 22. This limits the method for mounting the elements (the order of mounting the elements), thereby possibly diminishing mounting capability.

In the first embodiment, the drive circuit connector 63 is connected to the central connectors 43, 54 in the axial direction of the valve element 17. Moreover, the central connectors 43, 54 are attached to the actuator body 22 in the same direction as that in which the bodies 48, 55 of the bus bars 41, 42 are attached to the grooves 49, 56 (the axial direction of the valve element 17). Accordingly, the method for mounting the elements is not limited, and therefore mounting capability is less likely to be diminished.

Second Embodiment

Figure 7:
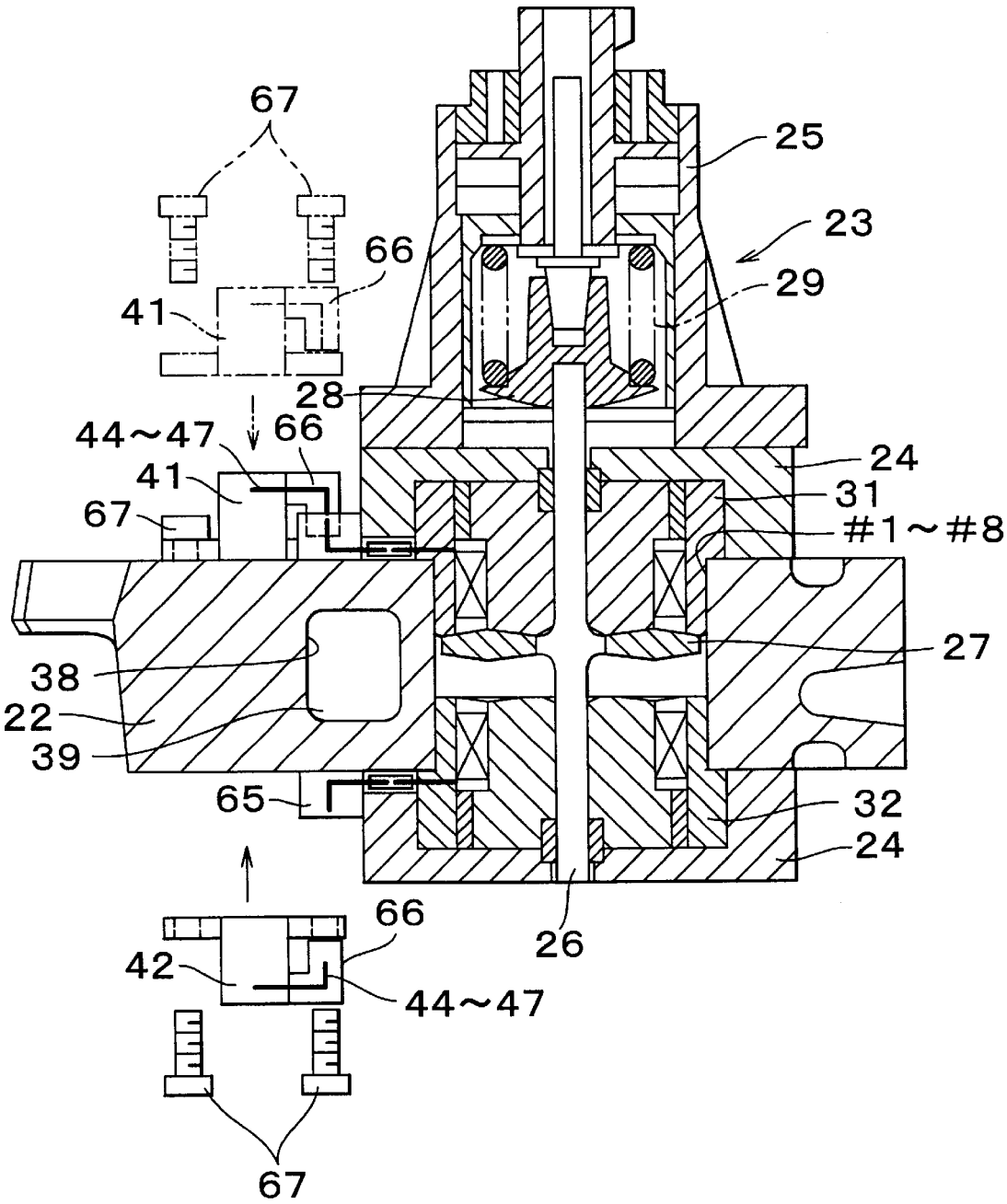
FIG. 7 is a partial cross-sectional view of the state where bus bars are mounted to an actuator body having electromagnetic actuators mounted thereto according to a second embodiment of the invention.

Hereinafter, the second embodiment of the invention will be described with reference to FIG. 7. In the second embodiment, each core assembly 31, 32 has an actuator connector 65 and each bus bar 41, 42 has a bus bar connector 66 as a wiring connector at the end of the bar-like conductive members 44 to 47. The actuator connector 65 and the bus bar connector 66 are provided in order to electrically connect the electromagnetic actuators 23 and the bus bars 41, 42. Each electromagnetic actuator 23 is fixed to the cylinder head 12 by fixing means such as bolts. Each bus bar 41, 42 is fixed to the actuator body 22 by fixing means such as bolts 67. The bus bars 41, 42 are mounted to the actuator body 22 in the axial direction of the valve element 17 (the vertical direction in FIG. 7). Moreover, the bus bar connector 66 is connected to the actuator connector 65 in the same direction as that in which the bus bars 41, 42 are mounted to the actuator body 22. The structure of the second embodiment is otherwise the same as that of the first embodiment. The same members as those of the first embodiment are denoted with the same reference numerals and characters, and a description thereof is omitted.

In the second embodiment having the above structure, the electromagnetic actuators 23 and the bus bars 41, 42 are mounted to the actuator body 22 while electrically connecting the electromagnetic actuators 23 with the bus bars 41, 42. This is implemented as follows: the electromagnetic actuators 23 are fixed to the actuator body 22 by fixing means. The bus bars 41, 42 are then moved up or down toward the actuator body 22. In the course of moving the bus bars 41, 42, the bus bar connector 66 is connected to the actuator connector 65. Thereafter, the bus bars 41, 42 are fixed to the actuator body 22 by the bolts 67. It is apparent from FIG. 7 that the bus bars 41, 42 are mounted to the actuator body 22 in the direction generally parallel to the axial direction of the valve element 17 of the electromagnetic actuator 23.

The second embodiment provides the following effects in addition to the effects (1) to (7) of the first embodiment.

(8) The bus bar connector 66 is connected to the actuator connector 65 in the same direction as that in which the bus bars 41, 42 are mounted to the actuator body 22. Accordingly, the bus bar connector 66 is connected to the actuator connector 65 while the bus bar 41, 42 is being moved toward the actuator body 22. In this way, the bus bars 41, 42 are mounted to the actuator body 22 and electrically connected to the electromagnetic actuators 23 by a simple operation requiring a small number of steps.

(9) The bolts 67 for fixing the bus bars 41, 42 to the actuator body 22 also function to prevent the bus bar connector 66 from being disconnected from the actuator connector 65. This function is obtained not only because the elements are connected to each other in the direction described above, but also because the bus bars 41, 42 are fixed to the actuator body 22 by the bolts 67 after the bus bar connector 66 is connected to the actuator connector 65. Accordingly, the bus bar connector 66 and the actuator connector 65 need not have a separate mechanism for preventing the bus bar connector 66 from being disconnected from the actuator connector 65, enabling reduction in size of the connectors 66, 65.

(Third Embodiment)

Figure 8:
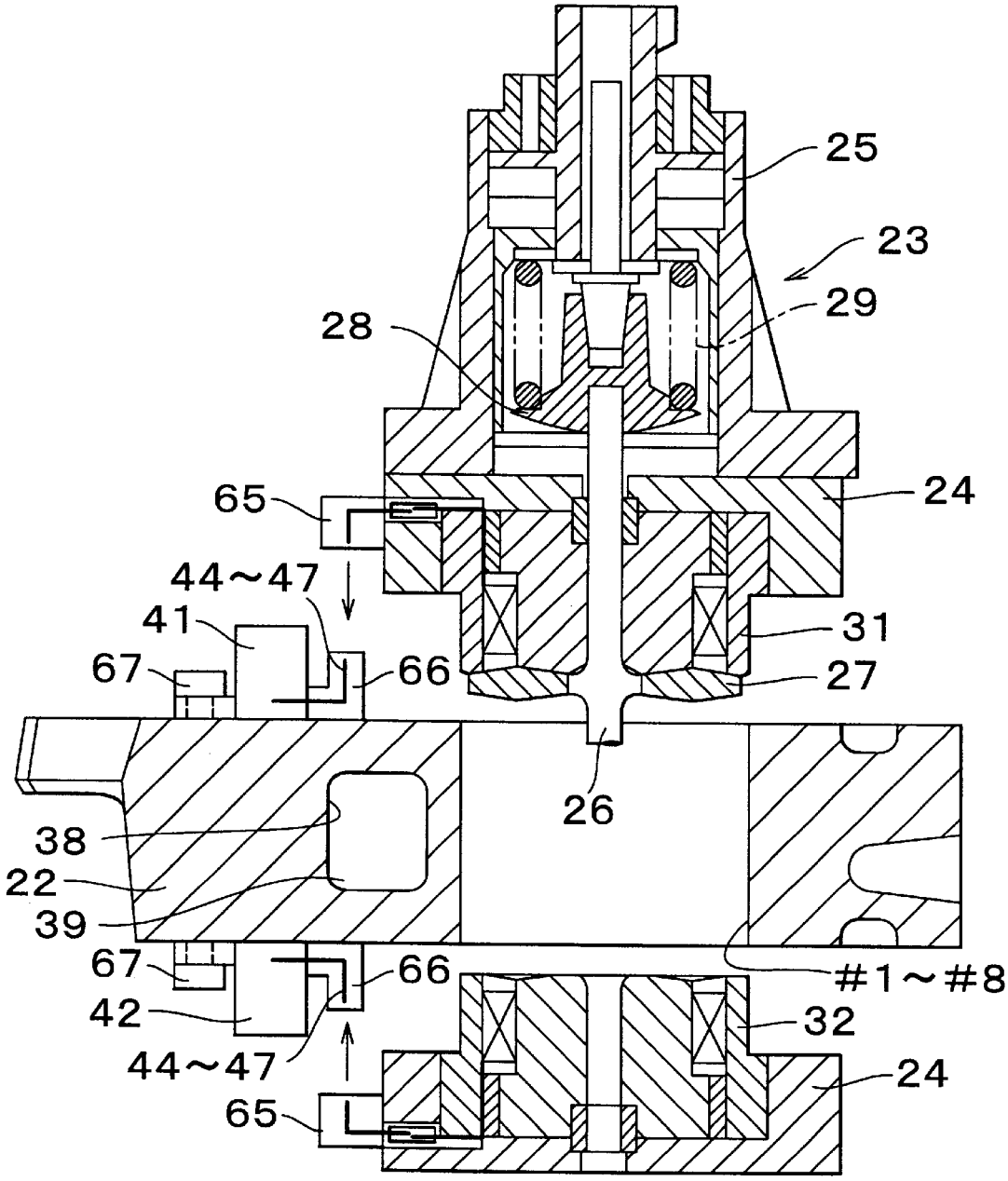
FIG. 8 is a partial cross-sectional view of the state where electromagnetic actuators are mounted to an actuator body having bus bars mounted thereto according to a third embodiment of the invention.

Hereinafter, the third embodiment of the invention will be described with reference to FIG. 8. In the third embodiment, each core assembly 31, 32 has an actuator connector 65 and each bus bar 41, 42 has a bus bar connector 66 as a wiring connector at the end of the bar-like conductive members 44 to 47. The actuator connector 65 and the bus bar connector 66 are provided in order to electrically connect the electromagnetic actuators 23 and the bus bars 41, 42. Each electromagnetic actuator 23 is fixed to the cylinder head 12 by fixing means such as bolts. Each bus bar 41, 42 is fixed to the actuator body 22 by fixing means such as bolts 67. The actuator bar connector 65 is connected to the bus bar connector 66 in the same direction as that in which the electromagnetic actuators 23 are mounted to the actuator body 22 (the vertical direction in FIG. 8). The structure of the third embodiment is otherwise the same as that of the first embodiment. The same members as those of the first embodiment are denoted with the same reference numerals and characters, and description thereof is omitted.

In the third embodiment having the above structure, the electromagnetic actuators 23 and the bus bars 41, 42 are mounted to the actuator body 22 while electrically connecting the electromagnetic actuators 23 with the bus bars 41, 42. This is implemented as follows: the bus bars 41, 42 are fixed to the actuator body 22 by the bolts 67. The core assemblies 31, 32 are then moved up or down toward the actuator body 22. In the course of moving the core assemblies 31, 32, the actuator connector 65 is connected to the bus bar connector 66. Thereafter, the core assemblies 31, 32 are fixed to the actuator body 22 by fixing means such as bolts. It is apparent from FIG. 8 that the electromagnetic actuators 23 are mounted to the actuator body 22 in the direction generally parallel to the axial direction of the valve element 17 of the electromagnetic actuator 23.

The third embodiment provides the following effects in addition to the effects (1) to (7) of the first embodiment.

(10) The actuator connector 65 is connected to the bus bar connector 66 in the same direction as that in which the electromagnetic actuators 23 are attached to the actuator body 22. Accordingly, the actuator connector 65 is connected to the bus bar connector 66 while the electromagnetic actuators 23 are being moved toward the actuator body 22. The electromagnetic actuators 23 are mounted to the actuator body 22 and electrically connected to the bus bars 41, 42 by a simple operation requiring a small number of steps.

(11) The fixing means for fixing the electromagnetic actuators 23 to the actuator body 22 also function to prevent the actuator connector 65 from being disconnected from the bus bar connector 66. This function is obtained not only because the elements are connected to each other in the direction described above, but also because the electromagnetic actuators 23 are fixed to the actuator body 22 by the fixing means after the actuator connector 65 is connected to the bus bar connector 66. Accordingly, the actuator connector 65 and the bus bar connector 66 need not have a separate mechanism for preventing the actuator connector 65 from being disconnected from the bus bar connector 66, enabling reduction in size of the connectors 66, 65.

Other embodiments of the invention will be described below.

In each of the above embodiments, the upper bus bar 41 is used to distribute electric power to the upper core assembly 31, and the lower bus bar 42 is used to distribute electric power to the lower core assembly 32. However, a common bus bar may alternatively be used to distribute electric power to both core assemblies 31, 32.

Figure 9:
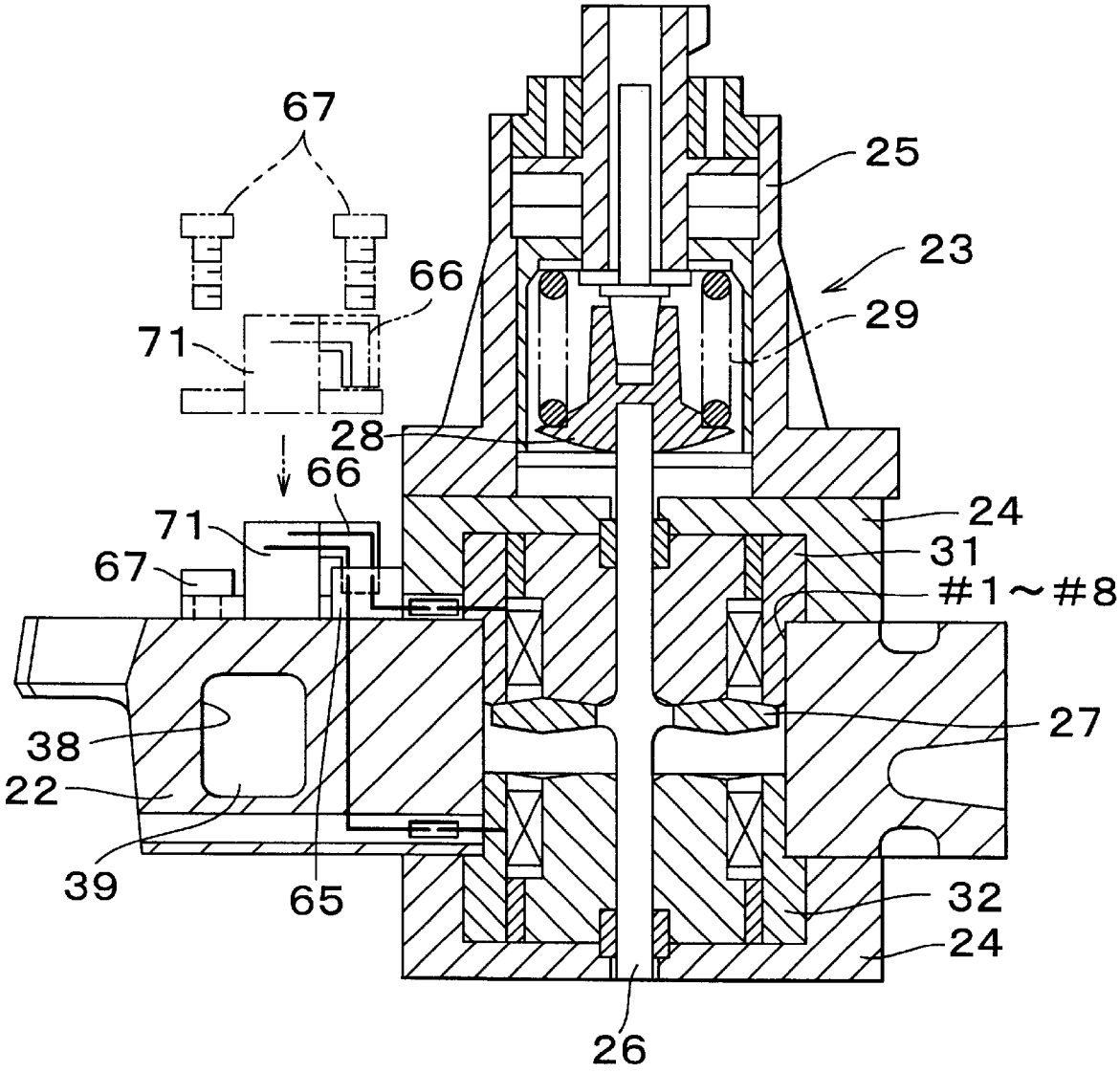
FIG. 9 is a partial cross-sectional view of another embodiment using a common bus bar.

As shown in FIG. 9, if the common bus bar is used in the second embodiment, a common actuator connector 65 is provided for the core assemblies 31, 32. A bus bar connector 66 is provided at the end of the bar-like conductive members 44 to 47 of the common bus bar 71. The bus bar connector 66 is connected to the actuator connector 65 in the same direction as that in which the bus bar 71 is mounted to the actuator body 22 (the vertical direction in FIG. 9).

In the above structure, the electromagnetic actuators 23 and the bus bar 71 are mounted to the actuator body 22 while electrically connecting the electromagnetic actuators 23 with the bus bar 71. This is implemented as follows: the electromagnetic actuators 23 are fixed to the actuator body 22. The bus bar 71 is then moved toward the actuator body 22. In the course of moving the bus bar 71, the bus bar connector 66 is connected to the actuator connector 65. Thereafter, the bus bar 71 is fixed to the actuator body 22 by bolts 67. This structure provides the same functions and effects as those of the second embodiment. Although not described in the specification, the bus bars 41, 42 of the third embodiment may be replaced with the common bus bar. This structure provides the same functions and effects as those of the third embodiment.

Figure 10:
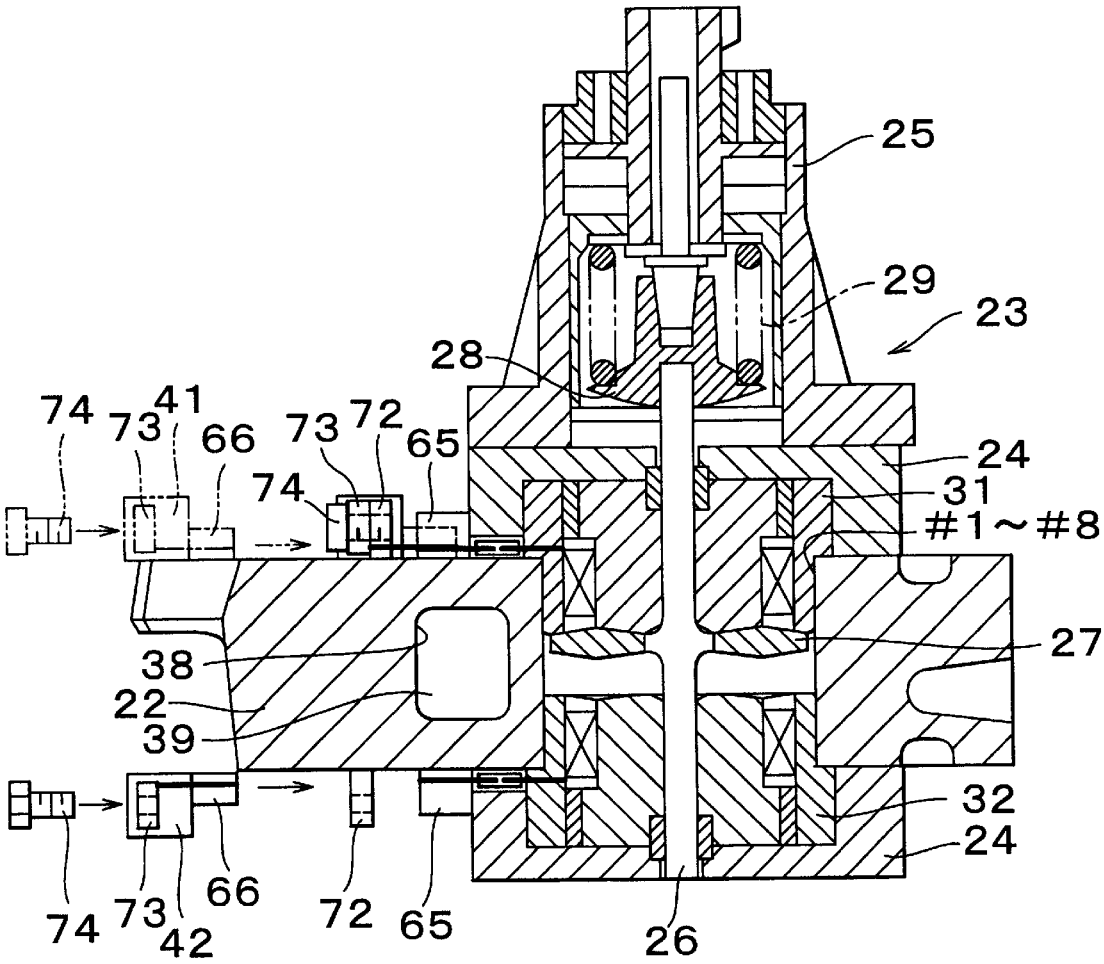
FIG. 10 is a partial cross-sectional view of still another embodiment in which bus bars are mounted to an actuator body in a different direction.

In the second embodiment, the bus bars 41, 42 may alternatively be mounted to the actuator body 22 in the direction crossing (e.g., perpendicular to) the axial direction of the valve element 17. In this case, as shown in, e.g., FIG. 10, the actuator body 22 and the bus bars 41, 42 have attaching portions 72, 73, respectively. The attaching portions 72, 73 are connected together by fixing means such as bolts 74. The bus bars 41, 42 are thus mounted to the actuator body 22 in the direction crossing the axial direction of the valve element 17 (the horizontal direction in FIG. 10). The bus bar connector 66 is connected to the actuator connector 65 in the same direction as that in which the bus bars 41, 42 are mounted to the actuator body 22. This structure provides the same functions and effects as those of the second embodiment.

Figure 11:
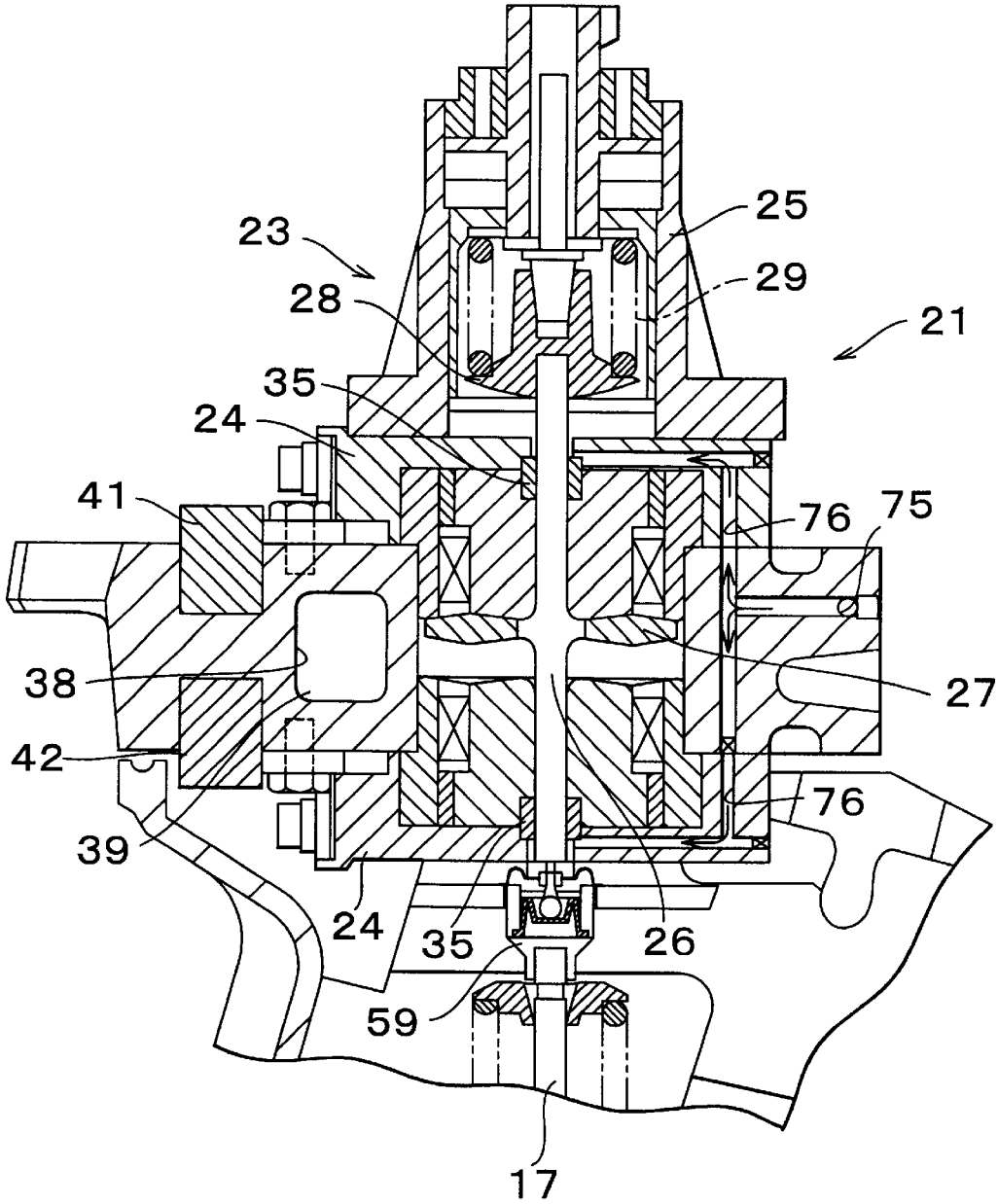
FIG. 11 is a partial cross-sectional view of yet another embodiment having an oil path within an actuator body or the like in addition to a flow path.

As described above, the actuator body 22 has a flow path 38 for allowing the cooling medium 39 to flow therethrough. The actuator body 22 may additionally have an oil path for supplying lubricating oil to elements such as slide bearings 35 in the electromagnetic actuators 23 and valve guides 16. In the example of FIG. 11, the actuator body 22 has an oil path for supplying lubricating oil to the upper and lower slide bearings 35. In this case, the actuator body 22 may have a main oil path 75 extending in the direction in which the valve elements 17 are arranged (the direction perpendicular to the plane of FIG. 11), and branch paths 76 branching from the main oil path 75 to each slide bearing 35. This structure allows lubricating oil to sequentially flow through the main oil path 75 and the upper and lower branch paths 76 into corresponding slide bearings 35 as shown by arrows in FIG. 11.

This simplifies the structure for supplying lubricating oil as compared to the case where piping is provided outside the actuator body 22 and the like as an oil path. Moreover, the structure for supplying lubricating oil can be reduced in size.

The electromagnetic actuators 23 may be cooled by the lubricating oil flowing through the oil path. In particular, supplying lubricating oil having a temperature adjusted by an oil cooler or the like through the oil path would further improve the cooling effect.

Note that, as shown in FIG. 11, the upper branch path 76 desirably has a greater diameter than that of the lower branch path 76. This is because the lubricating oil flowing through the main oil path 75 can be generally uniformly distributed to the upper and lower slide bearings 35.

In the embodiments additionally having the oil path, the oil path may be provided near the flow path 38. This enables the lubricating oil within the oil path to be cooled by the cooling medium 39 flowing through the flow path 38, and thus eliminates the need for an element such as oil cooler of the lubricating oil. This is effective for simplified structure and reduced cost.

Figure 12:
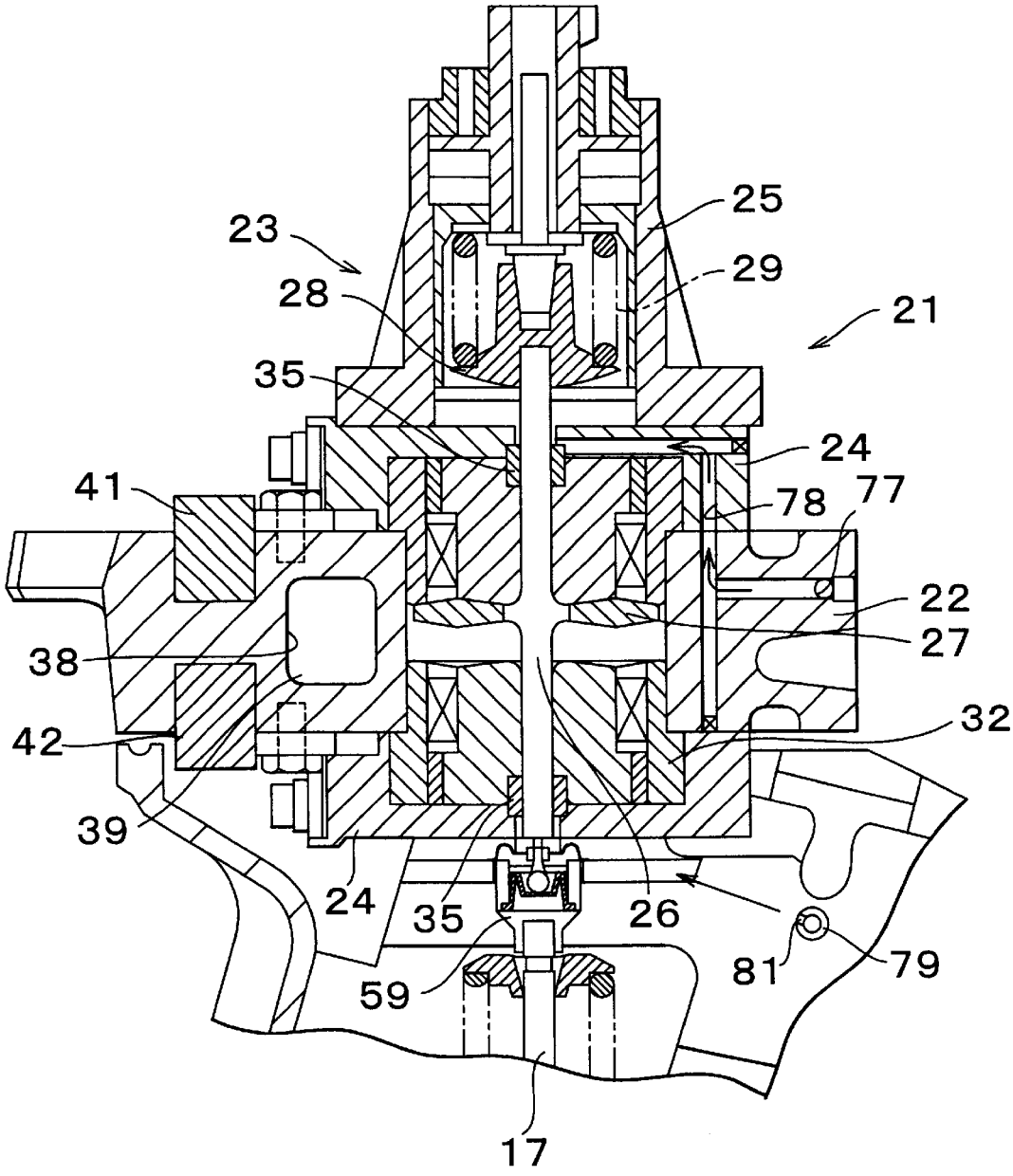
FIG. 12 is a partial cross-sectional view of a further embodiment having an oil path within an actuator body or the like in addition to a flow path.

As shown in FIG. 12, an oil path for supplying lubricating oil to the upper slide bearing 35 may be provided separately from an oil path for supplying lubricating oil to the lower slide bearing 35 and valve guides (not shown). For example, a main oil path 77 extending in the direction in which the valve elements 17 are arranged (the direction perpendicular to the plane of FIG. 12) may be provided in the actuator body 22 as the former oil path. A branch path 78 connecting the main oil path 22 to the upper slide bearing 35 is provided in the actuator body 22 and the upper flange 24.

For example, an oil pipe 79 extending in the direction in which the valve elements 17 are arranged may be provided in the cylinder head 12 as the latter path. The inner space of the oil pipe 79 is used as an oil path. The oil pipe 79 has injection holes 81 at positions corresponding to the lower slide bearing 35 and the valve guides. The lubricating oil flowing through the oil pipe 79 is injected from the injection holes 81 toward the lower slide bearing 35, the valve guides and the like.

This simplifies the structure for supplying lubricating oil as compared to the case where piping is provided outside the actuator body 22 and the like as an oil path. Moreover, the structure for supplying lubricating oil can be reduced in size.

In FIG. 6, in order to magnetically shield the drive circuit connector 63 connected to the central connectors 43, 54, a lid of a magnetic shielding material may be attached to the head cover 61 so as to cover the driving apparatus circuit connector 63.

In each of the above embodiments, the valve driving apparatus 21 for driving intake valves and the valve driving apparatus 21 for driving exhaust valves are provided separately. However, these valve driving appratuses 21 may be integrated into a single element.

The inner core 33 and the outer core 34 may be integrated into a single member as a core.

Instead of the bus bars 41, 42, copper wires covered with a material such as soft synthetic resin (cables, cords or the like) may be used as wires. In this case, the wires are provided near the flow path 38, as in the case where the bus bars 41, 42 are used.

The bodies 48, 55 of the bus bars 41, 42 may have a different shape from that of the first embodiment. For example, the shapes of the top and bottom surfaces of the body 48 of the upper bus bar 41 may be reversed. In other words, the body 48 may have a stepped top surface and a flat bottom surface. Furthermore, the stepped surface may be replaced with a tilted surface.

The technical ideas that can be understood from the above embodiments will be described below together with the effects thereof.

(A) In the valve driving apparatus of the internal combustion engine according to claim 2 or 3, the bus bar is mounted to the actuator body by fitting the body of the bus bar into the groove formed in the actuator body. The clearance between the wall surface of the groove and the body is filled with a synthetic resin.

This structure facilitates heat transmission from the bar-like conductive members to the actuator body as compared to the case where there is a clearance between the wall surface of the groove and the body. This enables a reduction in thickness of the bar-like conductive members and thus a reduction in space for power distribution while suppressing overheating of the bar-like conductive members.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the sprit and scope of the invention.

What is claimed is:

1. A valve driving apparatus of an internal combustion engine, comprising:

a valve element functioning as an intake valve or an exhaust valve of the internal combustion engine;

an electromagnetic actuator for driving the valve element;

an actuator body having a plurality of electromagnetic actuators mounted thereto; and wiring provided in a groove which is formed in the actuator body for supplying electric power to each of the electromagnetic actuators, wherein the actuator body has a flow path for allowing a cooling medium to flow therethrough, and the wiring is provided near the flow path of the actuator body, the wiring is a bus bar having a plurality of bar-like conductive members and a synthetic resin body filling at least a clearance between walls of the groove and the wiring adjacent bar-like conductive members, the plurality of bar-like conductive members of the bus bar extends in a direction in which the electromagnetic actuators are arranged, and each bar-like conductive member has one end connected to a corresponding electromagnetic actuator and the other end connected to a central connector, a thickness of the body of the bus bar is reduced as the number of bar-like conductive members is reduced, and a clearance between the actuator body and the wiring mounted thereto is filled with a synthetic resin.

2. The valve driving apparatus according to claim 1, wherein the actuator body having the electromagnetic actuators and the wiring both mounted thereto is attached to a cylinder head and covered with a head cover of the internal combustion engine, and the actuator body has a central connector having the wiring connected thereto, and a driving apparatus circuit connector is detachably connected to the central connector via a through hole formed in an upper surface of the head cover.

3. The valve driving apparatus according to claim 2, wherein the wiring has a wiring connector, the electromagnetic actuator has an actuator connector, and the actuator connector is connected to the wiring connector where the wiring is mounted to the actuator body.

4. The valve driving apparatus according to claim 3, wherein the electromagnetic actuator is mounted to the actuator body in a direction generally parallel to an axial direction of the valve element of the electromagnetic actuator.

5. A valve driving apparatus of an internal combustion engine, comprising:

a valve element functioning as an intake valve or an exhaust valve of the internal combustion engine;

an electromagnetic actuator for driving the valve element;

an actuator body having a plurality of electromagnetic actuators mounted thereto; and wiring provided in a groove which is formed in the actuator body for supplying electric power to each of the electromagnetic actuators, wherein the actuator body has a flow path for allowing a cooling medium to flow therethrough, and the wiring is provided near the flow path of the actuator body, and a clearance between the actuator body and the wiring mounted thereto is filled with a synthetic resin, the synthetic resin filling in the clearance between walls of the groove and the wiring.

6. A valve driving apparatus of an internal combustion engine, comprising:

a valve element functioning as an intake valve or an exhaust valve of the internal combustion engine;

an electromagnetic actuator for driving the valve element;

an actuator body having a plurality of electromagnetic actuators mounted thereto; and wiring for supplying electric power to each of the electromagnetic actuators, wherein the actuator body has a flow path for allowing a cooling medium to flow therethrough, and the wiring is provided near the flow path of the actuator body, the actuator body having the electromagnetic actuators and the wiring both mounted thereto is attached to a cylinder head and covered with a head cover of the internal combustion engine, the actuator body has a central connector having the wiring connected thereto, and a driving apparatus circuit connector is detachably connected to the central connector via a through hole formed in an upper surface of the head cover, and the driving apparatus circuit connector is connected to the central connector in substantially the same direction as an axial direction of the valve element of the electromagnetic actuator.

7. The valve driving apparatus according to claim 6, wherein the electromagnetic actuator has an actuator connector, the wiring has a wiring connector, and the wiring connector is connected to the actuator connector where the electromagnetic actuator is mounted to the actuator body.

8. The valve driving apparatus according to claim 6, wherein the wiring is mounted to the actuator body in a direction generally parallel to an axial direction of the valve element of the electromagnetic actuator.

9. The valve driving apparatus according to claim 6, wherein the wiring is mounted to the actuator body in a direction that crosses an axial direction of the valve element of the electromagnetic actuator.

10. The valve driving apparatus according to claim 6, wherein the wiring has a wiring connector, the electromagnetic actuator has an actuator connector, and the actuator connector is connected to the wiring connector where the wiring is mounted to the actuator body.

11. The valve driving apparatus according to claim 6, wherein the electromagnetic actuator is mounted to the actuator body in a direction generally parallel to an axial direction of the valve element of the electromagnetic actuator.

* * * * *